US008488988B2

(12) United States Patent
Lee et al.

(10) Patent No.: US 8,488,988 B2
(45) Date of Patent: Jul. 16, 2013

(54) PRINTERS AND APPARATUS TO REDUCE EMISSIONS FROM A PRINT SUBSTRATE EXIT PORT

(75) Inventors: Michael H. Lee, San Jose, CA (US); Seongsik Chang, Santa Clara, CA (US); Omer Gila, Cupertino, CA (US); Paul F. Matheson, San Bruno, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 358 days.

(21) Appl. No.: 12/914,758

(22) Filed: Oct. 28, 2010

(65) Prior Publication Data

US 2012/0107008 A1 May 3, 2012

(51) Int. Cl.
*G03G 21/20* (2006.01)

(52) U.S. Cl.
USPC ..... 399/91

(58) Field of Classification Search
USPC ..... 399/91–93, 98–101, 107, 110, 405
See application file for complete search history.

(56) References Cited

U.S. PATENT DOCUMENTS 5,533,890 A 7/1996 Holst et al.
7,386,247 B2 6/2008 Doi
8,139,995 B1 * 3/2012 Fujita et al. ..... 399/390
8,238,779 B2 * 8/2012 Doshoda et al. ..... 399/92
2010/0019455 A1 1/2010 Kent, Jr. et al.
2010/0183327 A1 * 7/2010 Kajiwara et al. ..... 399/93

FOREIGN PATENT DOCUMENTS

JP 2004240270 8/2004

OTHER PUBLICATIONS

"Reducing VOC Solvent Use in the Printing Industry," Printing Industries Association of Australia, http://www.printnet.com.au/verve/_resources/VOC_Report-members.pdf (40 pages).

Barker, Lauren. "Reducing Volatile Organic Compounds to Zero to Meet Future Industrial Environmental Standards," Industrial Environmental Standards, http://www.weblbdesigns.com/links/Reducing%20VOCs%20to%20Zero.pdf (12 pages).

* cited by examiner

*Primary Examiner* — Hoan Tran

(57) ABSTRACT

Printers and apparatus to reduce emissions from a print substrate exit port are disclosed. An example apparatus to reduce emissions from a print substrate exit port includes a first member coupled to a hinge adjacent a printer substrate exit port, the first member to substantially cover a travel path of a print substrate in a first position and to pivot from the exit travel path of the print substrate in response to air pressure associated with the print substrate when the print substrate travels through the print substrate exit port.

20 Claims, 5 Drawing Sheets

PRINTERS AND APPARATUS TO REDUCE EMISSIONS FROM A PRINT SUBSTRATE EXIT PORT

BACKGROUND

Some types of printer ink, such as ElectroInk, use volatile organic compounds as carrier fluids to deposit ink on a print substrate. Volatile organic compounds (VOCs) have workplace exposure limits and may contribute to smog. Therefore, VOCs may be subject to regulatory controls on emissions. Some printers use condensers to recover and/or recycle the VOC vapors after they are used to print.

DETAILED DESCRIPTION

Figure 1:
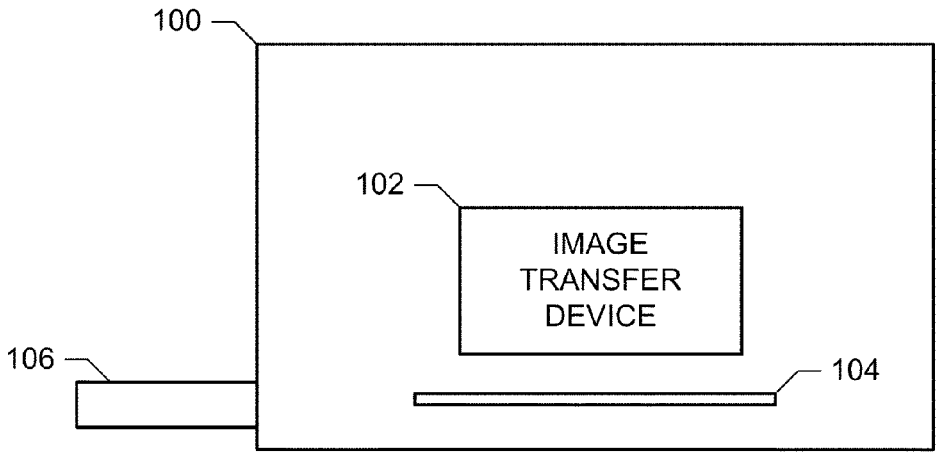
FIG. 1 illustrates an example print substrate exit configuration for an example large format electrophotographic printer.

FIG. 1 illustrates an example print substrate exit configuration for an example large commercial electrophotographic printer 100. The example printer 100 uses one or more inks that include a significant portion of oil. In some examples, the oil is a volatile organic compound (VOC) such as Isopar L. The use of VOCs creates a problem in that they have workplace exposure limits and contribute to smog. Thus, reducing or eliminating emissions of VOCs from the printer 100 is desirable. Emissions of VOCs may occur through any number of openings in the printer 100. While some of the openings may be sealed to the outside to prevent or substantially reduce emissions of VOCs, some openings may be impractical to seal. For example, a print substrate exit port 106 (e.g., an opening from which the print substrate 104 exits the printer 100 to a collection tray (not shown) after printing) may be impractical to seal because the print substrate 104 should generally be able to freely exit the printer 100 after an image is printed onto the print substrate 104. Thus, the exit port 106 creates a problem in that it permits VOCs to exit the printer 100.

More specifically, as ink containing VOCs is transferred to an image transfer device 102 and to a print substrate 104 (e.g., paper), the oil in the ink vaporizes into the internal air of the printer 100. In general, physical entities pull along a boundary layer of air (or other fluid) as they move. The print substrate 104 will thus carry the oil-laden air alongside the substrate 104 as it moves through the exit port 106. The thickness of this boundary layer is based on the object's size, speed, shape, distance of travel, and/or the density of the surrounding fluid. For an example in which the example printer 100 is implemented by an HP Indigo Series III press, calculations show the boundary layer upon leaving the printer 100 can be as much as 17 mm thick. The boundary layer thickness d may be determined as shown in equation 1 below.

$$d = 5\sqrt{\frac{\mu L}{\rho v}} = 5\sqrt{\frac{(1.5\times10^{-5}\text{Pa}\cdot\text{sec})(1\text{ m})}{(1.2\text{ kg/m}^3)(1.25\text{ m/sec})}} \quad \text{(Eq. 1)}$$

In equation 1, μ is the viscosity of air, L is the distance traveled by the substrate from a last contact (e.g., a paper roller) to the exit port, ρ is the density of air (which may include VOC vapors), and v is the speed of the print substrate. L is measured from a location at which the air boundary layer was last disrupted. For example, a full-width roller that contacts the print substrate and blocks an accompanying air boundary layer causes a new air boundary layer to begin from the location where the paper contacts the roller. Due to the air boundary layer that accompanies the print substrate 104 as it exits the exit port 106 and the concentration of VOCs in the air in the printer 100, VOCs may escape the printer 100 through the exit port 106 of FIG. 1.

Figure 2:
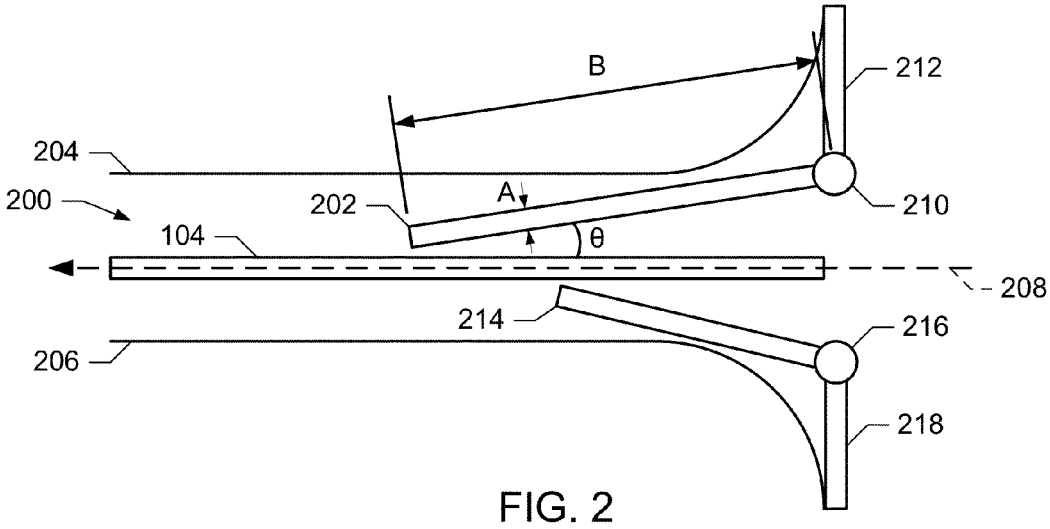
FIG. 2 is a schematic diagram of an example print substrate exit port having an airflow reducer flap constructed in accordance with the teachings herein.

FIG. 2 is a schematic diagram of an example print substrate exit port 200 having an airflow reducer flap 202. The example exit port 200 may be used to implement the print substrate exit port 106 of FIG. 1 to reduce an airflow traveling from the inside of the printer 100 via the exit port 106. In particular, the example airflow reducer flap 202 reduces emissions of VOCs from the print substrate exit port 200 by blocking and/or reducing the size and/or surface area of the print substrate exit port 200 to thereby reduce an airflow caused by the movement of the print substrate (e.g., the print substrate 104 of FIG. 1) out of the exit port 200.

The example print substrate exit port 200 of FIG. 2 is defined by an upper housing 204 and a lower housing 206. The print substrate 104 travels through the exit port 200 along a travel path 208. The travel path 208 is also a direction in which an airflow, caused by the movement of the print substrate 104, travels carrying VOCs from inside the printer 100.

To reduce the airflow escaping from the printer 100 via the example exit port 200, the airflow reducer flap 202 is coupled to the upper housing 204 via an upper hinge 210 and an upper hinge plate 212. The upper plate 212 is attached to the upper housing 204 and the flap 202 is pivotally coupled to the upper plate 212 via the hinge 210. The flap 202 is relatively light (e.g., less than 0.4 grams/centimeter of length), which allows the flap 202 to be urged out of the travel path 208 (e.g., to float above the print substrate 104) when the print substrate 104 moves along the travel path 208. To facilitate floating the flap 202, the flap 202 and the upper plate 212 are dimensioned in length B and positioned so that the flap 202 forms a shallow angle θ (e.g., about 30 degrees or less) with the print substrate 104. The example flap 202 of FIG. 2 is sufficiently stiff so that the flap 202 pivots around the upper hinge 210 instead of deforming due to the airflow, thereby improving the airflow reducing function of the flap 202.

To make the flap 202 sufficiently light so that the flap floats above the print substrate 104, sufficiently stiff so that the flap 202 does not flex, and/or sufficiently inert so that the flap 202 does not react with, deform, dissolve, and/or distort due to the VOC (e.g., Isopar), the flap 202 may be constructed using one or more of an appropriate polymer (e.g., Mylar, polycarbonate, polyethylene, polypropylene) and/or metal (e.g., aluminum). For example, the flap 202 may have a thickness A of about 100 micrometers (μm) to about 400 μm if it is constructed using a polymer. As another example, the flap 202 may have a thickness A of about 50 μm to about 100 μm if it is constructed using aluminum. In some examples, the print substrate 104 passes the flap 202 when the ink is not yet completely dry and is susceptible to scratching or marking upon contact. Therefore, the example flap 202 is advantageously constructed based on an expected range of travel speeds of the print substrate 104 so that the flap 202 floats just above the print substrate 104 and/or lightly touches the print substrate 104 as the substrate 104 exits the port, thereby preventing undesirable smearing or other damage to the printed image.

In some examples, the flap 202, the hinge 210, and/or the upper plate 212 are constructed such that the flap 202 has a limited pivoting range. For example, if the airflow caused by movement of the print substrate 104 is sufficiently strong, the example flap 202 of FIG. 2 contacts the upper housing 204 and cannot pivot further away from the print substrate 104. This limit on the pivoting range reduces an amount of VOCs that may escape the printer 100 when the airflow is strong enough to push the flap 202 farther than simply out of the path of the print substrate 104 because the flap 202 can more quickly return to a blocking position when the airflow sufficiently decreases. Additionally, the position stop provided by the upper housing 204 allows the flap 202 to be constructed to be lighter in weight as it is not necessary to use the inertia of the flap to prevent over rotation relative to the hinge 210. This lighter weight allows the flap 202 to more easily avoid and/or reduce contact with the print substrate 104.

The example print substrate exit port 200 of FIG. 2 further includes a lower flap 214, which is coupled to the lower housing 206 via a bottom hinge 216 and a lower hinge plate 218. Like the upper flap 202, the example lower flap 214 of FIG. 2 is dimensioned to form a shallow angle with the print substrate 104. The lower flap 214 may form an identical, similar, or substantially different angle with the print substrate 104 than the example angle θ associated with the upper flap 202. The airflow accompanying the print substrate 104 causes the substrate 104 to float above and/or lightly touch the lower flap 214. As a result, the lower flap 214 has little or no negative effect on the image printed on the print substrate 104.

As the example flap 202 floats above the print substrate 104, the boundary layer of air adjacent the print substrate 104 is disrupted by the flap 202. Specifically, the flap 202 blocks some or all of the boundary layer from continuing to accompany the print substrate 104 and retains the blocked air within the printer 100 by resisting the movement of the boundary layer. As the flap 202 floats closer to the print substrate 104, the flap 202 blocks more of the boundary layer and, thus, less air (and fewer VOCs) may escape the printer 100 via the exit port 200. Similarly, as the example print substrate 104 floats above the lower flap 214, the boundary layer of air under the print substrate 104 is blocked or disrupted by the lower flap 214. As the print substrate 104 floats closer to the lower flap 214, less air and fewer VOCs may escape the printer 100 via the exit port 200.

The airflow reducer flap 202 of the illustrated example is constructed of polycarbonate and has a thickness A of about 250 μm, a length B of about 50 millimeters (mm), and is positioned at an angle θ of about 30° or less relative to the print substrate 104. At a width (normal to the plane of the drawing) of 30 centimeters (cm), the example airflow reducer flap 202 of FIG. 2 has a mass of about 3.75 grams.

While the example airflow reducer flap 202 of FIG. 2 is referred to above as a flap, the airflow reducer flap 202 may be implemented using any rigid, substantially rigid, or flexible member such as a flap, an apron, a cover, a plate, and/or any other similar structure.

Figure 3:
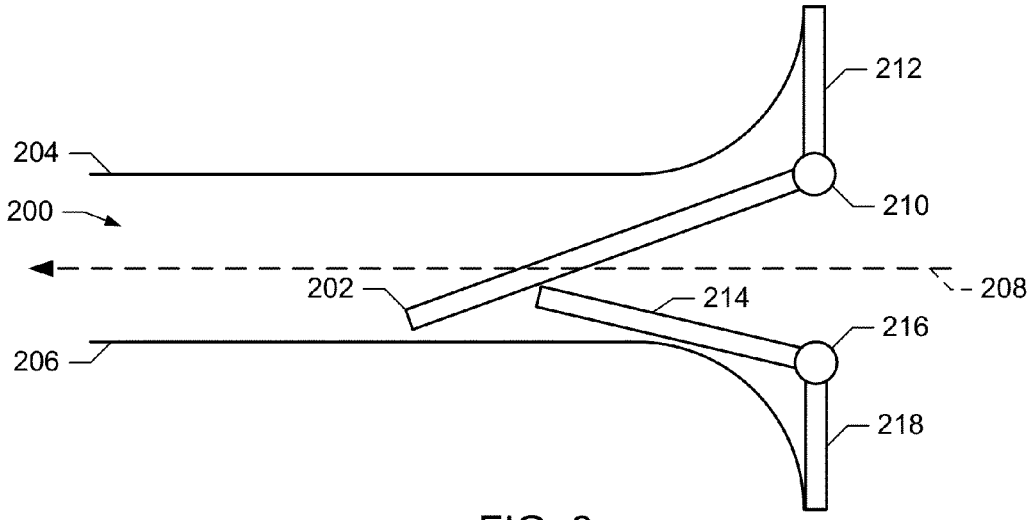
FIG. 3 is a schematic diagram of the example print substrate exit port of FIG. 2 shown with the airflow reducer flap blocking the print substrate exit port.

FIG. 3 is a schematic diagram of the example print substrate exit port 200 of FIG. 2 showing the airflow reducer flap 202 in a closed position where the exit port 200 is blocked or substantially blocked. As illustrated in FIG. 3, when the print substrate 104 is not traveling through the exit port 200, the example airflow reducer flap 202 pivots to obstruct or block the travel path 208 and exit port 200, which reduces or prevents air and, thus, VOCs from escaping the printer 100. In the illustrated example, the upper airflow reducer flap 202 pivots to contact the lower flap 214. However, in some other examples the airflow reducer flap 202 may pivot to contact the lower housing 206. The lower flap 214 may pivot to contact the upper flap 202 or upper housing 204 and/or both the upper and lower flaps 202 and 214 may pivot toward one another.

Figure 4:
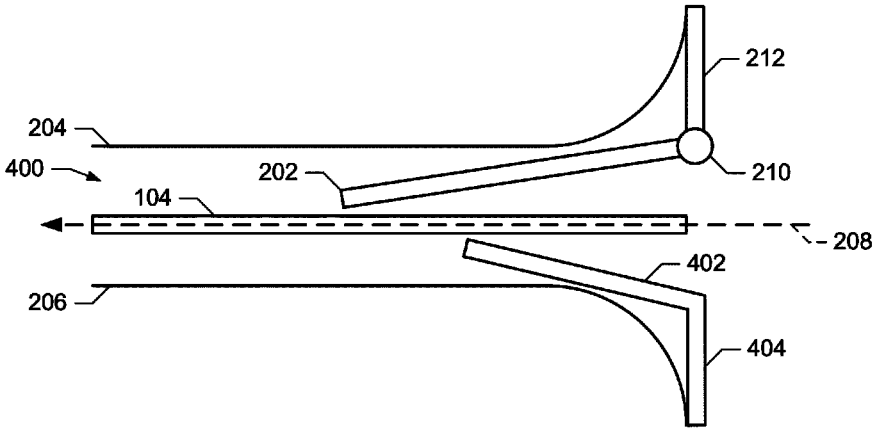
FIG. 4 is a schematic diagram of another example air flow reducer constructed in accordance with the teachings herein.

FIG. 4 is a schematic diagram of another example print substrate exit port 400. The example print substrate exit port 400 may be used to implement the example exit port 106 of FIG. 1 and includes the example airflow reducer flap 202, the example upper housing 204, the example lower housing 206, the example upper hinge 210, and the example upper hinge plate 212 of FIG. 2. The example print substrate exit port 400 further includes a lower flap 402. Unlike the example lower flap 214 of FIG. 2, the lower flap 402 does not include a hinge and instead is attached in a substantially fixed position to a lower plate 404. In some examples, the lower flap 402 and the lower plate 404 may be constructed using a single piece of material, while in some other examples the lower flap 402 and the lower plate 404 are different pieces of material that are fixed together at a desired angle.

Like the example exit port 200 of FIG. 2, the exit port 400 disrupts the air boundary layer(s) accompanying the print substrate 104 as it exits the port 400. The example print substrate exit port 400 may be advantageously used when the lower housing would not support a hinged lower flap such as the lower flaps of FIGS. 2 and 3 at a desired angle. The lower flap 402 and the lower plate 404 of FIG. 4 may be constructed at any desired angle to float the print substrate 104 at the desired position above the lower flap 402. In some examples, the lower flap 402 is substantially fixed at a shallow angle (e.g., 30° or less) relative to the example travel path 208.

Figure 5:
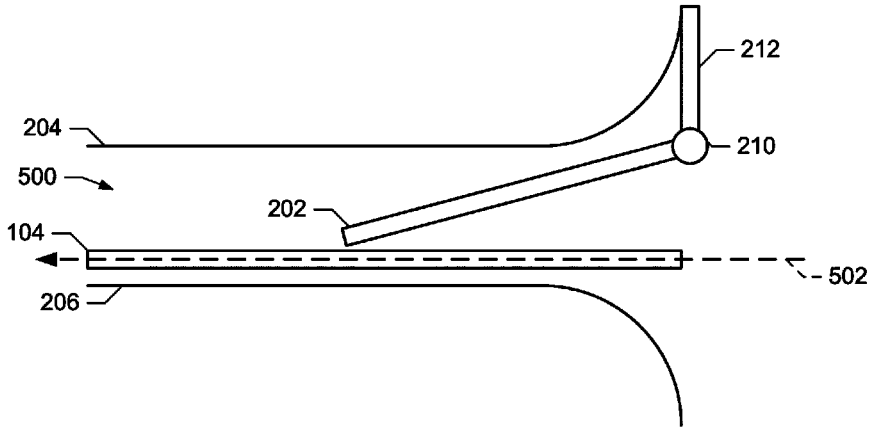
FIG. 5 is a schematic diagram of another example air flow reducer constructed in accordance with the teachings herein.

FIG. 5 is a schematic diagram of another example print substrate exit port 500. The example print substrate exit port 500 may be used to implement the example exit port 106 of FIG. 1 and includes the example airflow reducer flap 202, the example upper housing 204, the example lower housing 206, the example upper hinge 210, and the example upper hinge plate 212 of FIG. 2.

In contrast to the example exit ports 200 and 400 described above, the example print substrate exit port 500 does not include a lower flap. Instead, the print substrate floats above the lower housing 206 along a travel path 502. The example airflow reducer flap 202 forms a relatively small angle with the print substrate 104 and, thus, the airflow caused by the print substrate 104 causes the flap 202 to float above and/or lightly touch the print substrate 104. When the print substrate 104 is not present, the flap 202 pivots to contact the lower housing 204 to cover the exit port 500, thereby reducing or preventing VOCs from escaping the printer 100.

Like the example exit port 200 of FIG. 2, the exit port 400 disrupts the air boundary layer(s) accompanying the print substrate 104 as it exits the port 400. While the example print substrate exit port 500 may allow more VOCs to escape the printer 100 (e.g., between the print substrate 104 and the lower housing 206) than the example print substrate exit ports 200 and 400 of FIGS. 2 and 4, the example exit port 500 may be less costly to implement because there is no lower flap.

Figure 6:
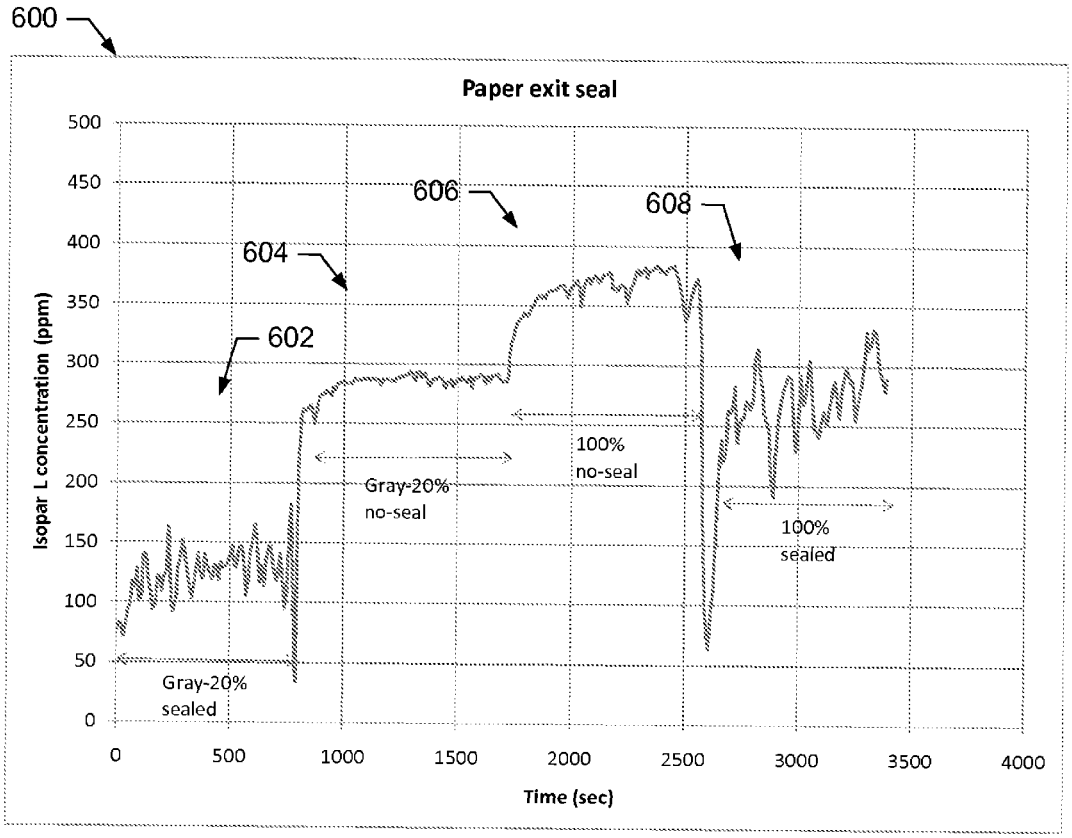
FIG. 6 is a graph illustrating example test results comparing emissions from an example exit port without an airflow reducer flap and from the example exit port with the example airflow reducer flap of FIG. 2.

FIG. 6 is a graph 600 illustrating example test results 602, 604, 606, and 608 performed on an exit port without an airflow reducer flap and on the same exit port with the example airflow reducer flap 202 of FIG. 2. The example test results 602-608 are representative of an Isopar concentration adjacent the print substrate 104 as it exits the example printer 100 of FIG. 1 via the print substrate exit port 106. The example test results 602 and 604 correspond to tests where the printer 100 generated 20% gray images. The example test results 606 and 608 correspond to tests where the printer 100 generated 100% solids images. The test results 604 and 606 are representative of tests during which the airflow reducer flap was not used. The test results 602 and 608 are representative of tests during which the example airflow reducer flap 202 and the lower flap 214 were used as described in FIG. 2.

As illustrated in FIG. 6, using the example airflow reducer flap 202 and the lower flap 214 reduced the concentration of Isopar in the air adjacent the print substrate 104 as it exited the print substrate exit port 106. In particular, the example airflow reducer flap 202 and the example lower flap 214 reduced the Isopar concentration adjacent the print substrate 104 for the 20% gray images from about 280 parts per million (ppm) to about 130 ppm. The example airflow reducer flap 202 and the example lower flap 214 also reduced the Isopar concentration adjacent the print substrate 104 for the 100% solid images from about 380 ppm to about 280 ppm. The higher concentration for the test results 606 and 608 with the 100% solid images is the result of the larger area (and volume) of ink applied to the print substrate 104 retaining some of the Isopar and releasing the Isopar over time. Thus, the example test results 602-608 demonstrate that the print substrate exit port 200 disrupts the boundary layer of air accompanying the print substrate 104 and reduces the amount of vapor escaping the printer 100.

Figure 7:
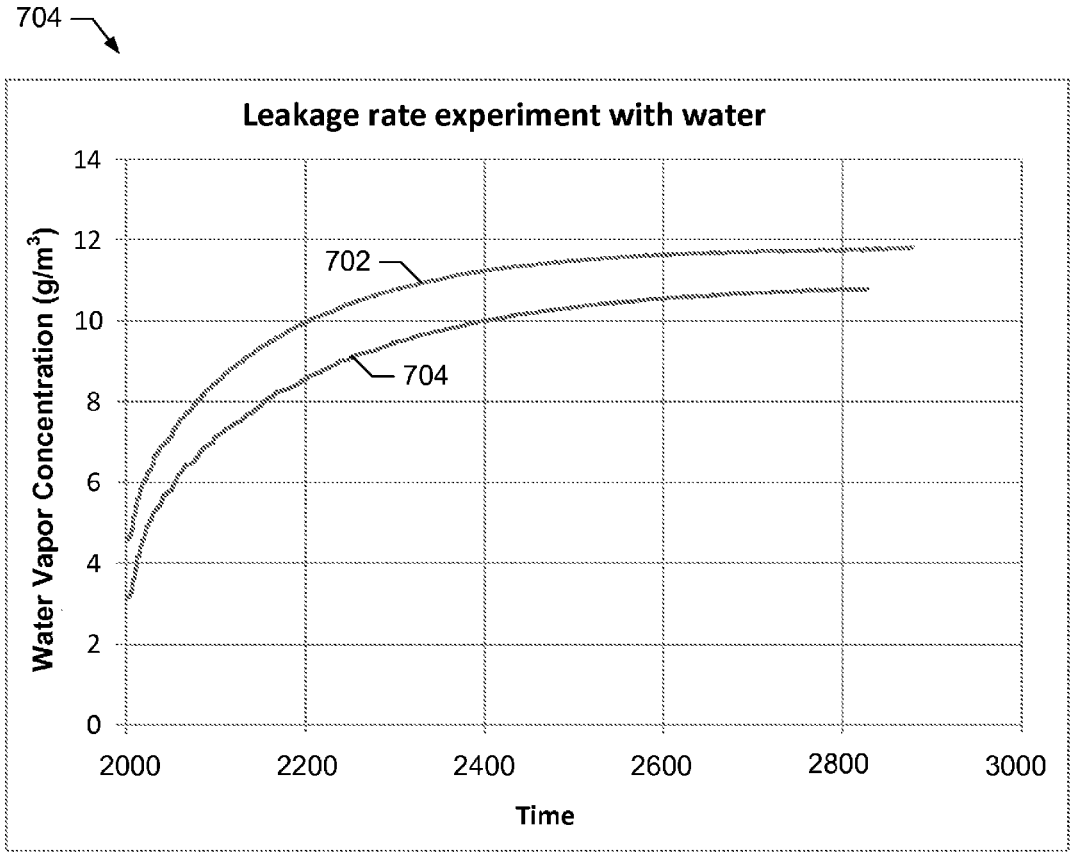
FIG. 7 is a graph illustrating example leakage rate test results performed on an example exit port without an airflow reducer flap and on the example exit port with an example airflow reducer flap constructed in accordance with the teachings herein.

FIG. 7 is a graph 700 illustrating example test results of printer air leakage rates 702 and 704 performed without an airflow reducer flap and with an example airflow reducer flap. The example test results 702 and 704 were obtained to determine a time constant $\tau$, which may be used to determine a volume leakage rate $Q_L$ of the tested printer as given by equation 2.

$$Q_L = V/\tau \quad \text{(Eq. 2)}$$

In equation 2, V is the internal volume of the tested printer (e.g., the printer 100). To generate the test results 702 and 704, the printer was filled with dry air and the relative humidity and temperature were then monitored to determine the change in water vapor density. Using the example flaps 202 and 204 of the print substrate exit port 200 of FIG. 2, the test results 704 had a time constant $\tau$ of about 170 seconds and $Q_L$ was about 17.6 liters per second (L/s). In contrast, with no flaps at the print substrate exit port, the test results 702 had a time constant $\tau$ of about 150 seconds and $Q_L$ was about 19.7 L/s. Thus, the example print substrate exit port 200 reduced the volume of vapor-laden air leakage of the press by about 2.1 L/s. 2.1 L/s of leakage through the exit port is more than 10% of the total leakage from the tested printer. However, if the total leakage rate is reduced to, for example, about 4 L/s (e.g., by sealing other sources of leakage from the printer), the leakage through the exit port may become a significant (e.g., 50% or higher) portion of the leakage.

To check print quality, 20% gray quality and photographic image quality images were printed on the print substrate 104 and passed through the example print substrate exit port 200 of FIG. 2. No scratches were detected on any of the print substrates 104 passing through the print substrate exit port 200 and, thus, the example airflow reducer flap 202 and the example lower flap 214 do not reduce print quality.

From the foregoing, it will be appreciated that the above disclosed apparatus reduce airflow through a print substrate exit port of a printer. In cases in which vapors are contained within the printer, emission of vapors through the exit port is also reduced. The example apparatus reduce the vapor emissions of the printer they modify while limiting or substantially avoiding contact with the print substrate so as not to scratch or otherwise damage the image to thereby avoid any print quality degradation. Additionally, the example apparatus may be implemented without adding substantial manufacturing costs to printers in which the apparatus are implemented.

While certain configurations and orientations are shown in the above-referenced drawings and described herein, other configurations and orientations are possible and this disclosure is not limited to the configurations and/or orientations shown. For example, "upper" and "lower" components are described below. However, "upper" and/or "lower" components may be reoriented and/or reconfigured without departing from the scope of teachings of this disclosure.

Although certain example methods, apparatus and articles of manufacture have been described herein, the scope of coverage of this patent is not limited thereto. On the contrary, this patent covers all methods, apparatus and articles of manufacture fairly falling within the scope of the claims of this patent.

What is claimed is:

1. An apparatus to reduce emissions from a printer substrate exit port, comprising a first member coupled to a hinge adjacent a printer substrate exit port, the first member to substantially cover a travel path of a print substrate in a first position and to pivot from the exit travel path of the print substrate in response to air pressure associated with the print substrate when the print substrate travels through the print substrate exit port.

2. An apparatus as defined in claim 1, wherein the first member is to form an angle of 30 degrees or less with the print substrate when the first member is in the first position.

3. An apparatus as defined in claim 1, further comprising a second member located adjacent the exit travel path opposite the first member.

4. An apparatus as defined in claim 3, wherein the second member is to reduce airflow under the print substrate.

5. An apparatus as defined in claim 3, wherein the first member is to contact the second member when in the first position.

6. An apparatus as defined in claim 3, wherein the second member is to form an angle of 30 degrees or less with the exit travel path.

7. An apparatus as defined in claim 1, further comprising a housing to limit a pivot range of the first member.

8. An apparatus as defined in claim 1, wherein the first member is to contact a housing around the print substrate exit port when covering the exit travel path.

9. An apparatus as defined in claim 1, wherein the first member has a mass less than about 0.4 grams per linear centimeter.

10. A printer with reduced emissions, comprising:

a housing;

a print substrate exit port defined in the housing; and an airflow reducer including a first flap coupled to the housing via a hinge, the first flap to reduce airflow through the exit port in a first position and to pivot from the travel path in response to air pressure associated with a print substrate when the print substrate moves through the exit port.

11. A printer as defined in claim 10, wherein the airflow reducer further comprises a second flap coupled to the housing adjacent the travel path on an opposite side of the housing from the first flap.

12. A printer as defined in claim 11, wherein the second flap is to reduce airflow through the exit port, and air pressure urges the print substrate away from the second flap.

13. A printer as defined in claim 11, wherein the first flap is to pivot into contact with the second flap when the print substrate is not moving through the exit port.

14. A printer as defined in claim 11, wherein the airflow reducer is to cover the travel path when the print substrate is not moving through the exit port.

15. A printer as defined in claim 10, wherein the housing is to limit a pivot range of the first flap.

16. A printer as defined in claim 10, wherein the first flap comprises a polymer or a metal.

17. A printer as defined in claim 10, wherein the first flap is to form an angle of 30 degrees or less with the print substrate when the print substrate moves through the exit port.

18. A printer as defined in claim 10, wherein the first flap is to float above the print substrate due to the airflow when the print substrate moves through the exit port.

19. A printer as defined in claim 10, wherein the first flap has a mass less than about 0.4 grams per linear centimeter.

20. A printer to reduce emissions through a print substrate exit port, comprising:

an image transfer device to generate an image on a print substrate;

a housing defining a print substrate exit port in communication with the image transfer device;

a first member pivotally coupled to the housing, the first member to cover the print substrate exit port when no print substrate is exiting the exit port, and to uncover the print substrate exit port in response to air pressure associated with the print substrate moving through the print substrate exit port; and a second member coupled to the housing, the second member to form a shallow angle with the print substrate to reduce airflow through the print substrate exit port, wherein the first and second members are to reduce fluid emissions through the print substrate exit port from a volume adjacent the image transfer device.

* * * * *